US010781640B2

(12) United States Patent
Johnson et al.

(10) Patent No.: US 10,781,640 B2
(45) Date of Patent: Sep. 22, 2020

(54) ROTARY CUTTING TOOL

(71) Applicant: SCHLUMBERGER TECHNOLOGY CORPORATION, Sugar Land, TX (US)

(72) Inventors: Ashley Bernard Johnson, Cambridge (GB); Jonathan Robert Hird, Cambridge (GB)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 153 days.

(21) Appl. No.: 15/579,221

(22) PCT Filed: Jun. 2, 2016

(86) PCT No.: PCT/US2016/035362
§ 371 (c)(1),
(2) Date: Dec. 4, 2017

(87) PCT Pub. No.: WO2016/196695
PCT Pub. Date: Dec. 8, 2016

(65) Prior Publication Data

US 2018/0179825 A1 Jun. 28, 2018

(30) Foreign Application Priority Data

Jun. 3, 2015 (GB) ..... 1509607.6

(51) Int. Cl.
*E21B 10/32* (2006.01)
*E21B 10/42* (2006.01)
(Continued)

(52) U.S. Cl.
CPC ..... *E21B 10/322* (2013.01); *E21B 7/28* (2013.01); *E21B 10/265* (2020.05);
(Continued)

(58) Field of Classification Search
CPC ..... E21B 10/322; E21B 10/325; E21B 10/60; E21B 10/5735; E21B 10/26; E21B 10/32;
(Continued)

(56) References Cited

U.S. PATENT DOCUMENTS 3,220,478 A * 11/1965 Kinzbach ..... E21B 29/005 166/55.8
3,237,705 A 3/1966 Williams, Jr.
(Continued)

FOREIGN PATENT DOCUMENTS

GB 2520998 A 6/2015
GB 2528454 A 1/2016
(Continued)

OTHER PUBLICATIONS

Extended European Search Report in European Patent Application No. 16804373.5, dated Jan. 3, 2019, 7 pages.

*Primary Examiner* — George S Gray

(57) ABSTRACT

A downhole cutting tool which may be a reamer or a mill has a rotary tool body with at least one block which carries hard-faced cutters and projects or is extensible from the tool body. A radially outward facing part of the cutter block defines a channel for fluid flow which extends generally axially along the cutter block. The channel is configured such that at least the rotationally trailing edge of the channel extends along the block in one or more directions which are inclined relative to the tool axis. This reduces or avoids the amount of channel edge parallel to the tool axis and thereby mitigates whirling and/or or vibration.

20 Claims, 10 Drawing Sheets

(51) Int. Cl.

| | |
|---|---|
| ***E21B 10/43*** | (2006.01) |
| ***E21B 10/573*** | (2006.01) |
| ***E21B 29/00*** | (2006.01) |
| ***E21B 7/28*** | (2006.01) |
| ***E21B 10/26*** | (2006.01) |
| ***E21B 10/60*** | (2006.01) |

(52) U.S. Cl.
CPC ..... *E21B 10/325* (2013.01); *E21B 10/42* (2013.01); *E21B 10/43* (2013.01); *E21B 10/60* (2013.01); *E21B 29/005* (2013.01); *E21B 10/5735* (2013.01)

(58) Field of Classification Search
CPC ..... E21B 10/62; E21B 10/00; E21B 10/46; E21B 10/42; E21B 7/28; E21B 29/005; E21B 17/10; E21B 17/1078; E21B 17/1092; E21B 9/36; E21B 2010/425; E21B 10/43; E21B 10/627; E21B 10/633; E21B 10/265; B24D 3/00; B24D 18/00
See application file for complete search history.

(56) References Cited

U.S. PATENT DOCUMENTS

| | | | | |
|---|---|---|---|---|
| 3,367,430 | A | 2/1968 | Rowley | |
| 3,825,083 | A * | 7/1974 | Flarity | E21B 10/46 175/394 |
| 5,004,057 | A * | 4/1991 | Tibbitts | E21B 7/064 175/408 |
| 6,386,302 | B1 | 5/2002 | Beaton | |
| 6,732,817 | B2 | 5/2004 | Dewey et al. | |
| 7,954,564 | B2 | 6/2011 | Makkar et al. | |
| 2003/0155155 | A1 | 8/2003 | Dewey et al. | |
| 2010/0018779 | A1 * | 1/2010 | Makkar | E21B 10/322 175/382 |
| 2011/0173896 | A1 | 7/2011 | Laird et al. | |
| 2011/0209922 | A1 * | 9/2011 | King | B22F 7/062 175/402 |

FOREIGN PATENT DOCUMENTS

| | | | |
|---|---|---|---|
| GB | 2528455 | A | 1/2016 |
| GB | 2528456 | A | 1/2016 |
| GB | 2528457 | A | 1/2016 |
| GB | 2528458 | A | 1/2016 |
| GB | 2528459 | A | 1/2016 |

* cited by examiner

ROTARY CUTTING TOOL

CROSS-REFERENCE TO RELATED APPLICATION

The present document is based on and claims priority to GB Non-Provisional Application Serial No.: 1509607.6, filed Jun. 3, 2015, which is incorporated herein by reference in its entirety.

BACKGROUND

In the context of drilling and working within an underground borehole, a reaming tool for enlarging the borehole may incorporate blocks which extend axially, face generally radially outwardly towards the wall of the borehole and carry cutters for removing material from the borehole wall to increase the diameter of the hole. Some reamers have blocks which are expandable outwardly from the tool body, enabling the reamer to be inserted into the borehole to a desired depth, and then expanded to enlarge the hole from that depth onwards. Expandable reamers are illustrated by U.S. Pat. Nos. 6,732,817 and 7,954,564. In other reamers the blocks are fixed to the central body of the tool but project outwardly from it. An illustration of a block which is integral to the body and projects from it is seen in U.S. Pat. No. 6,386,302.

Whether expandable from the tool body or fixed at positions projecting from it, there may be a plurality of cutter blocks distributed azimuthally around the tool axis.

It is normal practice that a rotary cutting tool such as a reamer can be incorporated in a drill string extending from surface or alternatively attached to coiled tubing extending from the surface. Drilling fluid is pumped down the drilling string or coiled tubing to the reamer tool and returns to the surface outside tubing with cuttings entrained in the returning fluid.

As is shown by U.S. Pat. Nos. 6,732,817 and 7,954,564, it is known for the outwardly facing parts of a cutter block to incorporate a channel which extends in the axial direction over part or all of the axial length of a cutter block. Such a channel can provide a pathway for the flow of drilling fluid returning towards the surface from below the cutter block. Flow along such a channel in the outer face of a block can enhance cooling of the block by the drilling fluid (because flow along the channel is additional to flow past the sides of the block) and can assist the removal of cuttings which have been formed at the leading edge of the block. Since such a channel provides a pathway for cuttings, it is sometimes referred to as a "junk slot".

As shown by U.S. Pat. Nos. 6,732,817 and 7,954,564, such a channel may also provide space for the insertion of a second row of cutters, behind a row of cutters which are at the leading edge as the tool rotates.

A desirable characteristic for a reamer, and indeed for many rotary cutting tools used in a borehole, is smooth rotation with the tool in its intended position centred on the borehole axis. In practice there can be unwanted vibration and a phenomenon referred to as "whirling" which is an undesirable motion in which tool axis does not remain centred within the hole but instead moves around the hole axis while the periphery of the tool makes repeated impacts against the wall of the hole.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

One aspect of the present disclosure provides a downhole cutting tool for enlarging the diameter of a hole, comprising a rotary tool body with at least one support member which carries cutters and which projects or is extensible from the tool body, wherein a radially outward facing part of the support member includes a channel for fluid flow which runs generally axially along the support member and wherein at least a rotationally trailing edge of the channel extends along the support member in a direction or succession of directions which are inclined relative to the tool axis.

Setting part or all of the channel at an angle inclined to the tool axis is a measure to mitigate vibration and whirling as the tool rotates. It reduces the amount of straight channel edge which is parallel to the tool axis. We have recognised that if a straight edge parallel to the tool axis strikes or snags on the borehole wall as the tool is rotating, it can transiently become a pivot axis around which the tool turns bodily, thereby initiating or perpetuating a whirling motion of the tool and/or increasing vibration.

The channel may be implemented so that the rotationally leading and trailing edges of parts of the channel are both inclined relative to the tool axis. However, the rotationally trailing edge of the channel is of course a leading edge of those parts of the support member which follow the channel and this edge presents more significant risk of impact to the borehole wall than does the leading edge of the channel. Consequently, the channel may be implemented such that some or all parts of the rotationally trailing edge are inclined relative to the tool axis while the corresponding parts of the leading edge are parallel to the tool axis or inclined at a smaller angle. Such an arrangement may give a channel which varies in width whereas in other embodiments parts of the channel which have the trailing edge inclined relative to the tool axis are constant width so that the leading edge is similarly inclined relative to the tool axis.

The trailing edge, or both edges, of the channel may comprise one or more straight sections inclined to the tool axis, one or more curved sections in which at least part of the curved section is inclined to the tool axis, or some combination of these. It is possible that the trailing edge, or both edges, of the channel will include one or more portions which do run parallel to the tool axis but these may be sufficiently short that at least 75% of the overall length of the trailing edge, or both edges, of the channel is inclined relative to the tool axis. The angle of inclination to the tool axis may be no more than 45° possibly not more than 35°. More specifically, at least 75% of the length of the trailing edge, or both edges, of the channel may be inclined at an angle of at least 10° and possibly at least 15° up to 35° or 45° relative to the tool axis.

In many embodiments the channel will extend from one axial end of the support member to the other axial end of the support member and will change inclination one or more times so that the channel keeps within the width of the support member. The support member for cutters may include one or more surfaces positioned to contact the borehole wall which has been cut by the cutters and the channel may extend across such surfaces, where its edges will also be edges of surfaces intended to contact the borehole wall. The support member may take the form of a block to which cutters are attached.

In some embodiments the rotary tool is a reamer which can be used to enlarge a borehole by cutting formation rock from a borehole wall. Such a tool may have cutters with polycrystalline diamond at the hard cutting surface. In other embodiments the rotary tool is a mill to remove metal from the interior wall of tubing secured in a borehole, possibly removing the entire thickness of the tubing wall from the interior so as to destroy the tubing. A mill may have cutters of tungsten carbide or other hard material which is not diamond.

In another aspect, there is disclosed here a method of enlarging a borehole or removing tubing secured in a borehole, comprising attaching a tool as stated above to tubing, inserting the tool and attached tubing into the hole, and rotating the tool to enlarge the diameter of the borehole or comminute the tubing fixed in the borehole, while flowing fluid from the surface to the tool and returning fluid from the tool to the surface while at least part of the fluid flow travels along the channel of the at least one support member.

DETAILED DESCRIPTION

Figure 1:
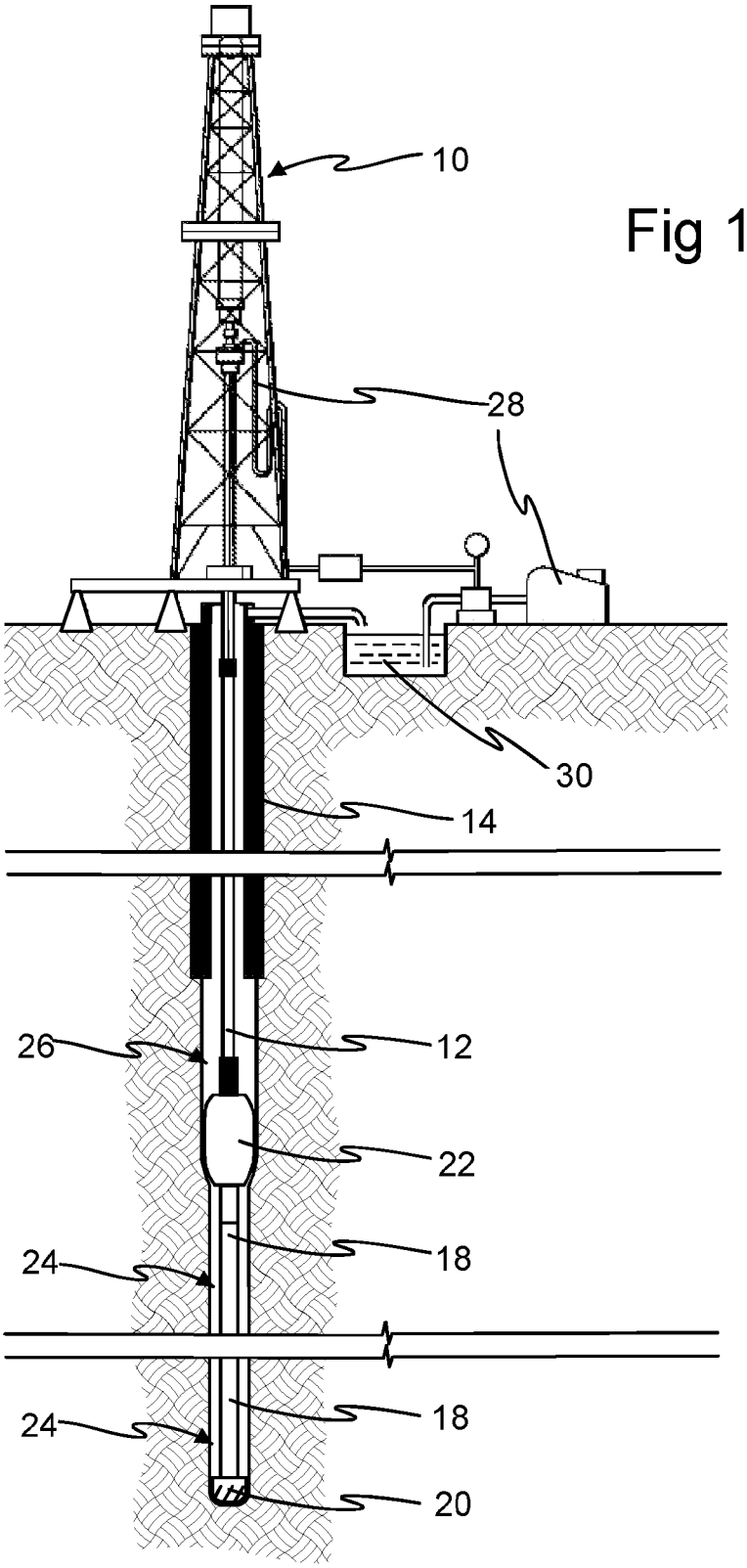
FIG. 1 is a schematic, cross-sectional view of a drilling assembly in a borehole.

FIG. 1 shows an exemplary drilling assembly which includes an expandable under-reamer 22. A drill string 12 extends from a drilling rig 10 into a borehole. An upper part of the borehole has already been lined with casing and cemented as indicated at 14. The drill string 12 is connected to a bottomhole assembly 18 which includes a drill bit 20 and an under-reamer 22 which has been expanded beneath the cased section 14. As the drill string 12 and bottomhole assembly 14 are rotated, the drill bit 20 extends a pilot hole 24 downwards while the reamer 22 simultaneously opens the pilot hole 24 to a larger diameter borehole 26.

The drilling rig is provided with a system 28 for pumping drilling fluid from a supply 30 down the drill string 2 to the reamer 22 and the drill bit 20. Some of this drilling fluid flows through passages in the reamer 22 and flows back up the annulus around the drill string 12 to the surface. The rest of the drilling fluid flows out through passages in the drill bit 20 and also flows back up the annulus around the drill string 12 to the surface.

As shown, the distance between the reamer 22 and the drillbit 20 at the foot of the bottom hole assembly is fixed so that the pilot hole 24 and the enlarged borehole 26 are extended downwardly simultaneously. It would be possible to use the same reamer 22 attached to drillstring 12 (but without the drill bit 20 and the part of the bottom hole assembly 18 below the reamer 22) in similar manner to enlarge an existing borehole.

Figure 2:
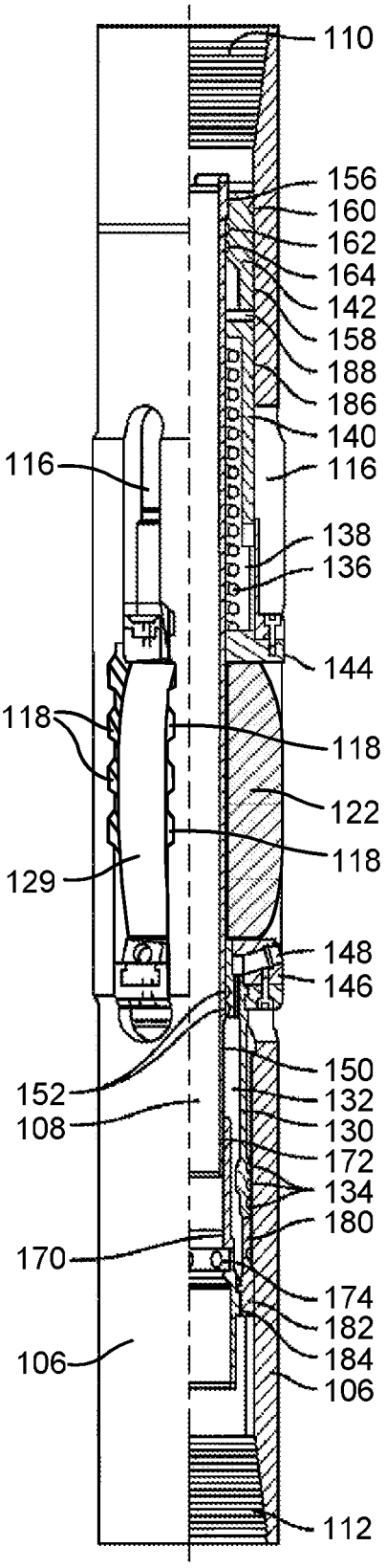
FIG. 2 is a cross-sectional elevation view of one embodiment of expandable reamer, showing its expandable blades in collapsed position.
Figure 3:
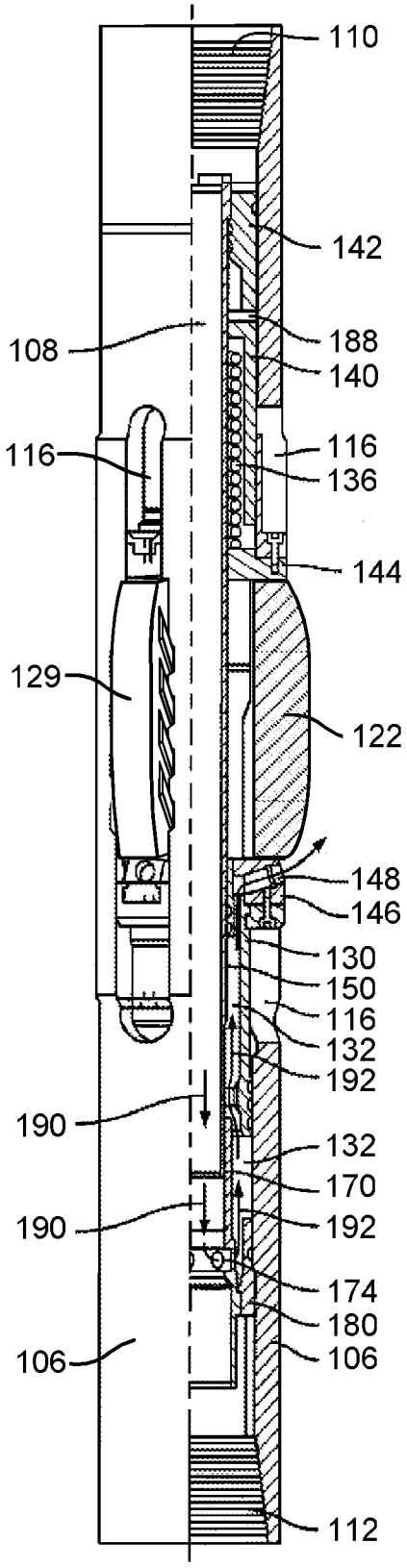
FIG. 3 is a cross-sectional elevation view of the expandable reamer of FIG. 2, showing the blades in expanded position.

Referring now to FIGS. 2 and 3, one embodiment of expandable reaming tool is shown in a collapsed position in FIG. 2 and in an expanded position in FIG. 3.

This expandable tool comprises a generally cylindrical tool body 106 with a central flowbore 108 for drilling fluid. The tool body 106 includes upper 110 and lower 112 connection portions for connecting the tool into a drilling assembly. Intermediately between these connection portions 110, 112 there are three recesses 116 formed in the body 106 and spaced apart at 120° intervals azimuthally around the axis of the tool.

Each recess 116 accommodates a cutter block 122 in its retracted position. The three cutter blocks are similar in construction and dimensions. The outer face 129 of the cutter block 122 is indicated without detail in FIGS. 2 and 3.

The cutter block 122 has side faces with protruding ribs 117 which extend at an angle to the tool axis. These ribs 117 engage in channels 118 at the sides of a recess 116 and this arrangement provides a pathway which constrains motion of each cutter block such that when each block 122 is pushed upwardly relative to the tool body 106, it also moves radially outwardly from the position shown in FIG. 2 to an expanded position shown in FIG. 3 in which the blocks 122 project outwardly from the tool body 106. It will be appreciated that each cutter block is constrained by the ribs 117 in channels 118 to move bodily upwardly and outwardly without changing its orientation (i.e. without changing its angular position) relative to the tool axis.

A spring 136 biases the blocks 122 downwards to the retracted position seen in FIG. 2. The biasing spring 136 is disposed within a spring cavity 138 and covered by a spring retainer 140 which is locked in position by an upper cap 142. A stop ring 144 is provided at the lower end of spring 136 to keep the spring in position.

Below the moveable blocks 122, a drive ring 146 is provided that includes one or more nozzles 148. An actuating piston 130 that forms a piston cavity 132 is attached to the drive ring 146. The piston 130 is able to move axially within the tool. An inner mandrel 150 is the innermost component within the tool, and it slidingly engages a lower retainer 170 at 172. The lower retainer 170 includes ports 174 that allow drilling fluid to flow from the flowbore 108 into the piston chamber 132 to actuate the piston 130.

The piston 130 sealingly engages the inner mandrel 150 at 152, and sealingly engages the body 106 at 134. A lower cap 180 provides a stop for the downward axial movement of piston 130. This cap 180 is threadedly connected to the body 106 and to the lower retainer 170 at 182, 184, respectively. Sealing engagement is provided at 586 between the lower cap 180 and the body 106.

A threaded connection is provided at 156 between the upper cap 142 and the inner mandrel 150 and at 158 between the upper cap 142 and body 106. The upper cap 142 sealingly engages the body 106 at 160, and sealingly engages the inner mandrel 150 at 162 and 164.

In operation, drilling fluid flows downwards in flowbore 108 along path 190, through ports 174 in the lower retainer 170 and along path 192 into the piston chamber 132. The differential pressure between the fluid in the flowbore 108 and the fluid in the borehole annulus surrounding tool causes the piston 130 to move axially upwardly from the position shown in FIG. 2 to the position shown in FIG. 3. A portion of the flow can pass through the piston chamber 132 and through nozzles 148 to the annulus as the cutter blocks start to expand. As the piston 130 moves axially upwardly, it urges the drive ring 146 axially upwardly against the blocks 122. The drive ring pushes on all the blocks 122 simultaneously and moves them all axially upwardly in recesses 116 and also radially outwardly as the ribs 150 slide in the channels 118. The blocks 122 are thus driven upwardly and outwardly in unison towards the expanded position shown in FIG. 3.

The movement of the blocks 122 is eventually limited by contact with the spring retainer 140. When the spring 136 is fully compressed against the retainer 140, it acts as a stop and the blocks can travel no further. There is provision for adjustment of the maximum travel of the blocks 122. This adjustment is carried out at the surface before the tool is put into the borehole. The spring retainer 140 connects to the body 106 via a screwthread at 186. A wrench slot 188 is provided between the upper cap 142 and the spring retainer 140, which provides room for a wrench to be inserted to adjust the position of the screwthreaded spring retainer 140 in the body 106. This allows the maximum expanded diameter of the reamer to be set at the surface. The upper cap 142 is also a screwthreaded component and it is used to lock the spring retainer 140 once it has been positioned.

Figure 4:
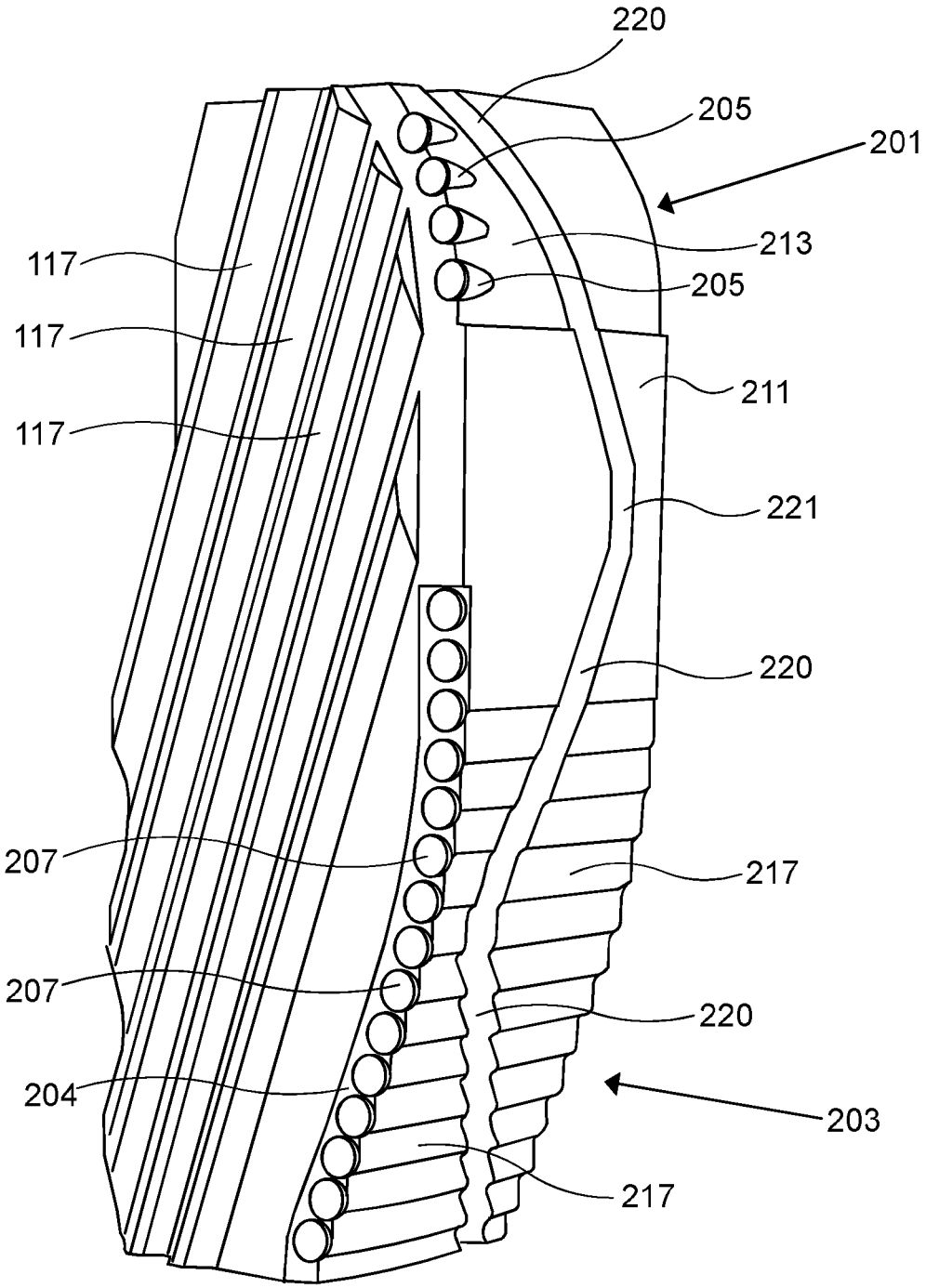
FIG. 4 is a perspective view of a cutter block for the expandable reamer of FIGS. 2 and 3.
Figure 5:
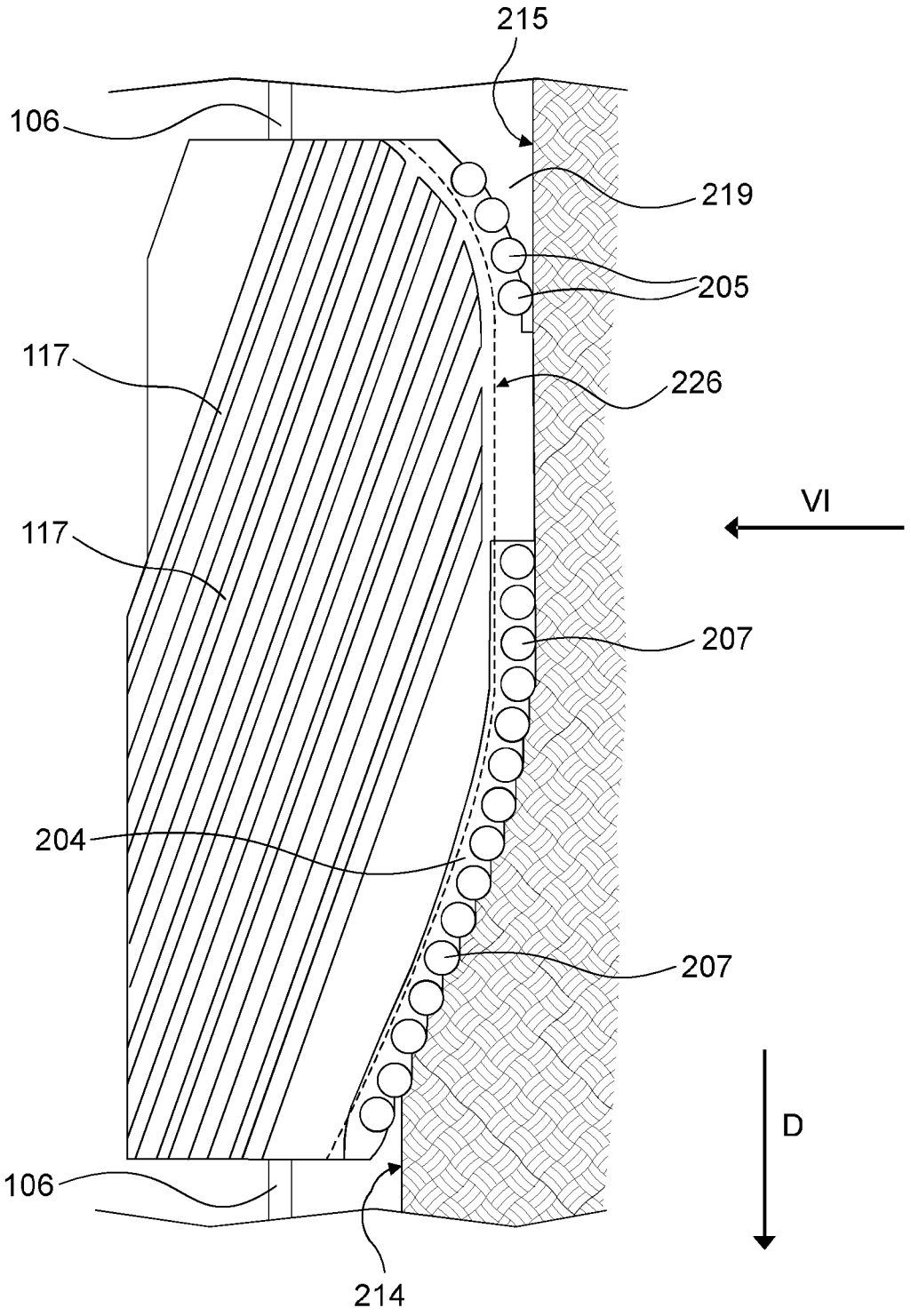
FIG. 5 is a side view of the cutter block of FIG. 4, shown in operation in a borehole.
Figure 6:
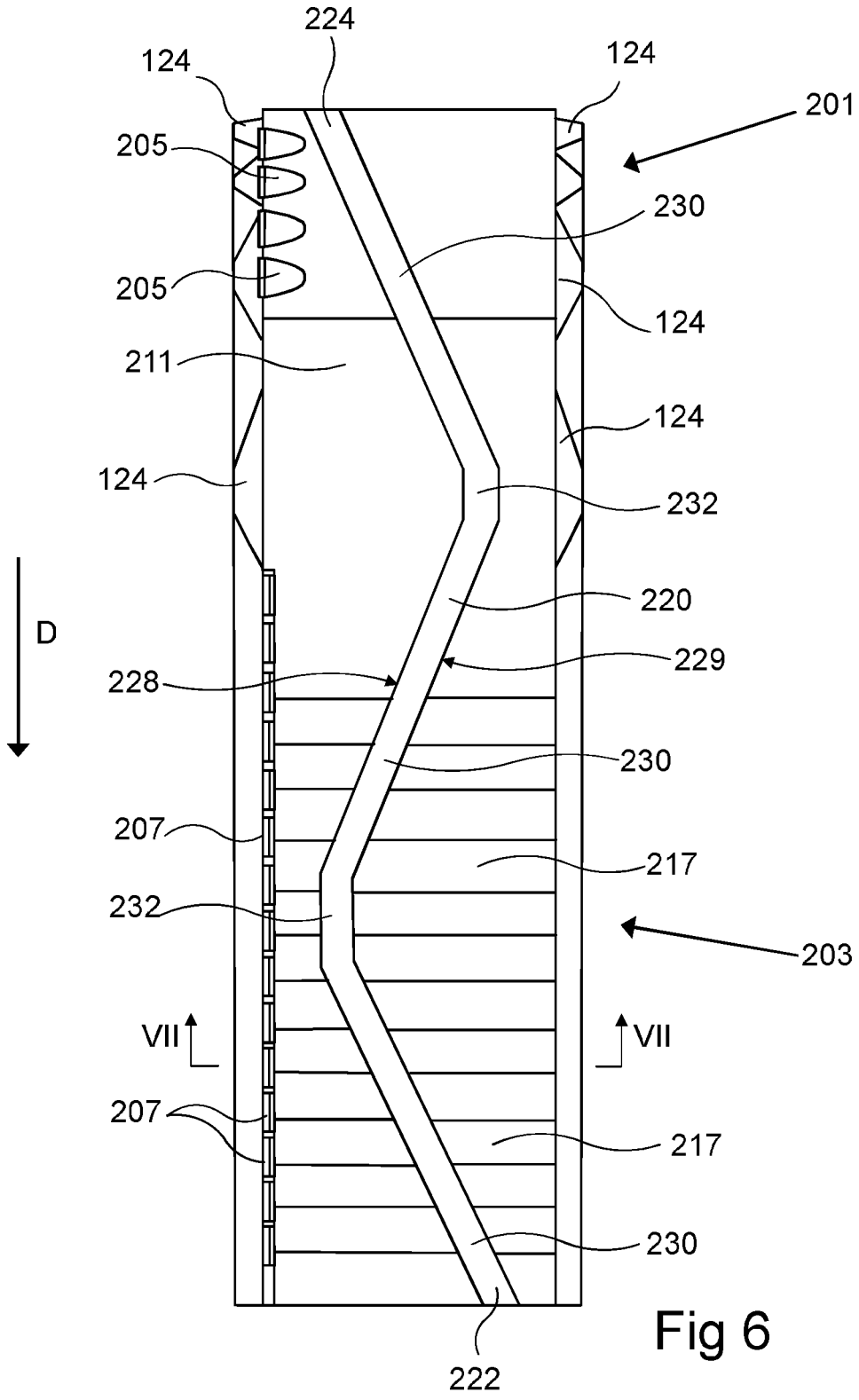
FIG. 6 is a view in the direction shown by arrow VI in FIG. 5, looking on to the radially outer face of the cutter block of FIGS. 4 and 5.

FIGS. 4 to 7 show a cutter block in more detail. The side face shown by FIG. 5 is the leading face in the direction of rotation of the tool. As already mentioned, the cutter block is a steel block with inclined ribs 117 on each side face. Ends 124 of ribs 117 are seen in FIG. 6. The inclined ribs are not seen in FIG. 7. Part of the wall of the tool body 106 is seen in FIG. 5.

The outer part of the block 122 has upper 201 and lower 203 cutting regions provided with cutters 205, 207. The upper and lower cutting regions 201, 203 are curved as shown by FIG. 5 so that the cutters 205, 207 in these regions are positioned radially outwards from the tool axis by amounts which are least at the top and bottom ends of the block 122 and greatest adjacent the middle section which includes stabilising pad 211. This stabilising pad 211 has a generally smooth, part-cylindrical outward surface positioned to face and slide over the borehole wall. To increase its resistance to wear, the stabilising pad may have pieces of harder material embedded in it and lying flush with the outward facing surface of the pad 211.

The cutters 205, 207 are polycrystalline diamond cutters (abbreviated to PDC cutters) which have a disc of diamond particles embedded in a binder matrix at one end of a cylindrical body of hard material which may be a mass of tungsten carbide particles embedded in a binder material. The cutters are secured in pockets formed in the steel block 122 so that the disc of diamond particles is exposed as a hard cutting surface. Securing the cutters 205, 207 in the pockets in the block 122 may be done by brazing although it is also possible for cutters to be secured mechanically in a way which allows them to rotate around their own axis thereby distributing wear. It has been normal practice for the hard disc of diamond crystals to provide a flat cutting surface as shown in the drawings. However, other shapes including cones can be used for the hard surface of a cutter.

When the reamer is advanced downwardly within a hole to enlarge the hole, it is the curved lower cutting regions 203 of its blocks 122 which do the work of cutting through formation rock. This takes place in FIG. 1 as the drill string 12 is advanced downwardly. It is normal practice for most of the work done by reamer to be done as the reamer is advanced downwardly. However, the enlarged portion of the borehole can also be extended upwardly if required, using the upper cutting regions 201 on the blocks 122 to remove formation rock while pulling upwardly on the drill string 12.

In the upper cutting region 201, the PDC cutters 205 are mounted so as to be partially embedded in the steel block 122 and project radially outwardly from the curved face 213 of the block.

Figure 7:
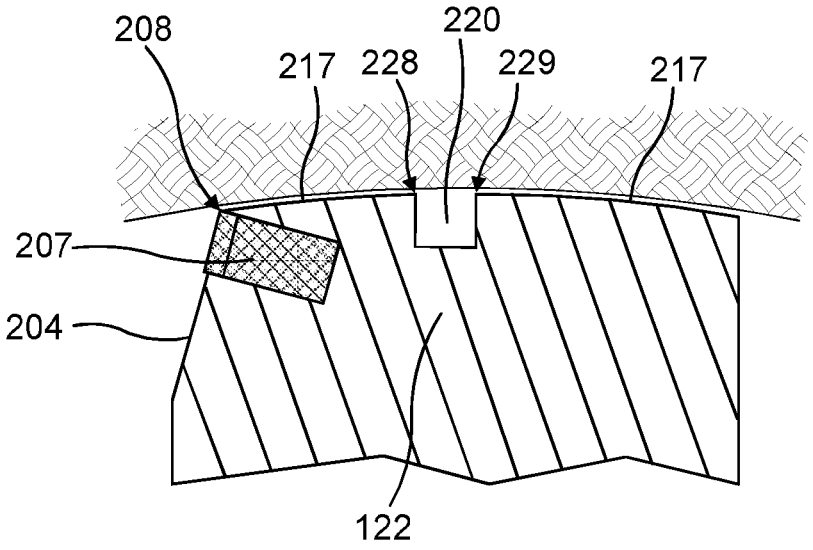
FIG. 7 is a cross-section on the line VII-VII of FIG. 6.

In the lower cutting region, a radially outer margin of the side face is inclined as a bevel 204 along the outer face of the block. The hard faces of the PDC cutters 207 are exposed within the area of this bevel 204. The block 122 is also formed with a succession of radially outward-facing surfaces 217 each located circumferentially behind and extending axially above a cutter 207. As best seen from FIG. 4 and FIG. 7, each surface 217 is at the same radial distance from the tool axis as the radially outer extremity 209 of its associated cutter 207 and so as indicated by FIG. 7 each surface 217 slides over the formation rock which has been cut by its associated cutter 207. The stabilising pad 211 is at the same radial distance from the tool axis as the extremities of the topmost three cutters 207.

The cutting action of the reamer as it rotates and advances downwardly is illustrated in FIG. 5 in which the downward direction is indicated by arrow D. The original borehole wall is indicated at 214. The cutters 207 cut material from the borehole wall, progressively increasing the borehole diameter to the finished enlarged diameter defined by the topmost three of the cutters 207. The stabilising pad 211 makes sliding contact with the enlarged borehole wall at this diameter.

It can be seen that the upper cutting region 201 curves away from the enlarged borehole wall 215 so that the upper cutters 205 do not contact the borehole wall while the reamer is advancing downwardly and there is a space 219 between the upper cutting region 201 and the borehole wall 215.

The block 122 has a channel 220 which runs along the length of the block from an inlet opening 222 at the lower end of the block 122 to an outlet opening 224 at the upper end of the block. While the reamer is in operation, some of the drilling fluid travelling upwardly around the drill string enters the channel 220 at its lower opening 222 and flows along this channel towards the upper outlet 224, cooling the block 122 as it does so. The position of the floor of this channel is indicated in FIG. 5 by broken line 226. As shown by FIG. 7, the channel intersects each surface 217, and likewise the stabilising pad 211, at a leading edge 228 and trailing edge 229.

Although this channel 220 extends generally axially along the block 122, most of it is made up by three portions 230 which are inclined at an angle of approximately 25° to the tool axis. The inclined portions 230 are connected by portions 232 which are parallel to the tool axis but are much shorter than the inclined portions 230. Consequently, the length of channel 220 which is parallel to the tool axis is small. This reduces the risk that an edge of the channel, parallel to the tool axis, will snag on the wall of the bore hole and become a pivot axis, thereby initiating or sustaining a whirling motion of the rotating tool.

Figure 8:
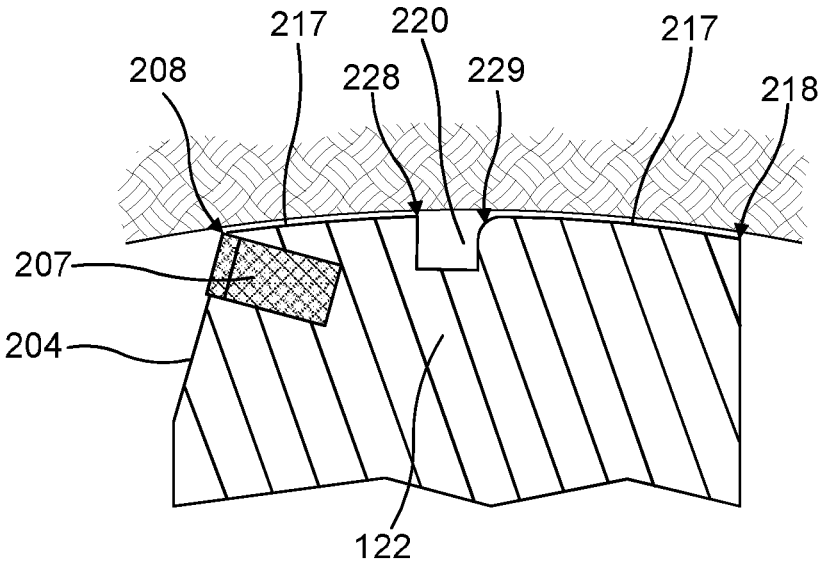
FIG. 8 is a similar cross-section to FIG. 7 showing a modification.

FIG. 8 shows a modification. The trailing edge 229 where the channel intersects the outer surfaces 217 and stabilising pad 211 is formed with a radius rather than with the right angle shown in FIG. 7. This further reduces any possibility for the edge 229 to snag on the rock formation. Possible further variations, not used in FIG. 8, would be for the leading edge 228 of the channel, and/or the trailing edges 218 of the outer surfaces 217 to be formed with a radius rather than a right angle.

Figure 9:
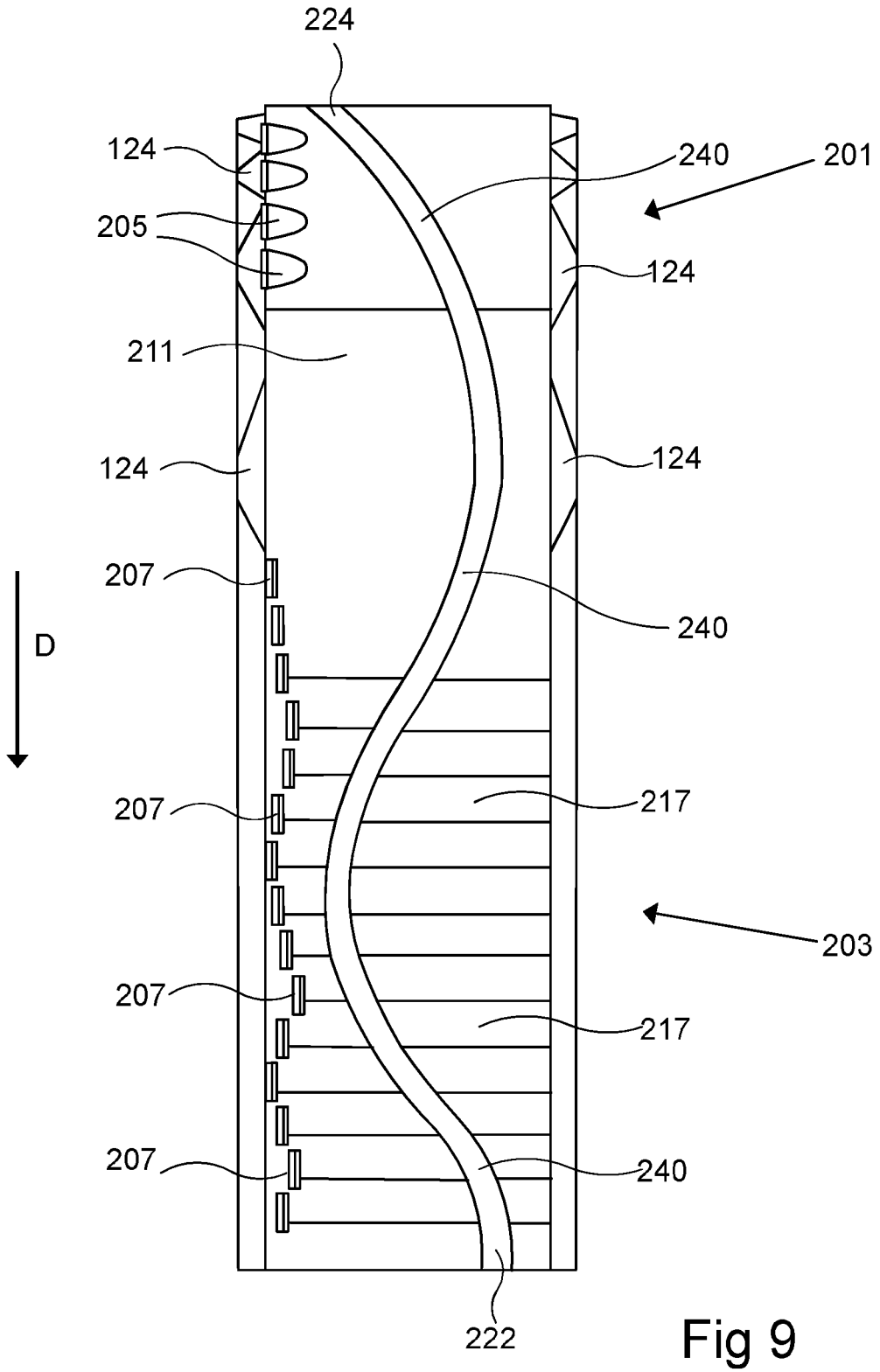
FIG. 9 is a similar view to FIG. 6, showing modifications.

FIG. 9 shows a channel 240 with different geometry. In place of inclined straight portions 230 and 232, the channel 240 is made up of a sequence of curved portions. A large part of each of these curved portions is at an angle of 15° or more to the tool axis.

FIG. 9 also shows the cutters 207 of the lower cutting region 203 with differences in circumferential position on the block 122 so that they are not aligned in a straight row. Their cutting faces therefore do not provide a single common line parallel to the tool axis. Of course this arrangement of the cutters 207 could also be used with a channel composed of straight portions 230 and 232 as shown in FIG. 6.

Figure 10:
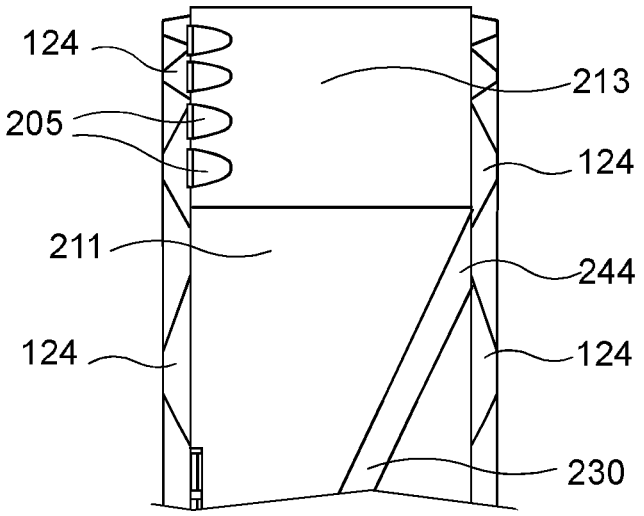
FIG. 10 is a view onto the upper part of the radially outer face of a cutter block similar to that in FIG. 6, showing another modification.

FIG. 10 shows another possible modification to the cutter block of FIGS. 4 to 7. In the lower cutting region 203, the channel 220 is just the same as shown in FIG. 6. The modification shown by FIG. 10 is that the channel does not extend over the upper cutting region 201. Instead one of the inclined portions 230 leads across the stabilising pad 211 to an outlet opening 244 at the rotationally trailing face of the cutter block. When the reamer is in use, drilling fluid will enter the channel through the inlet opening 222 at the lower end of the block and flow up to the outlet opening 244, thus cooling the lower cutting region 203 and the stabilising pad 211 which are the parts of the block where heat is generated while the reamer is being advanced axially downwardly.

Figure 11:
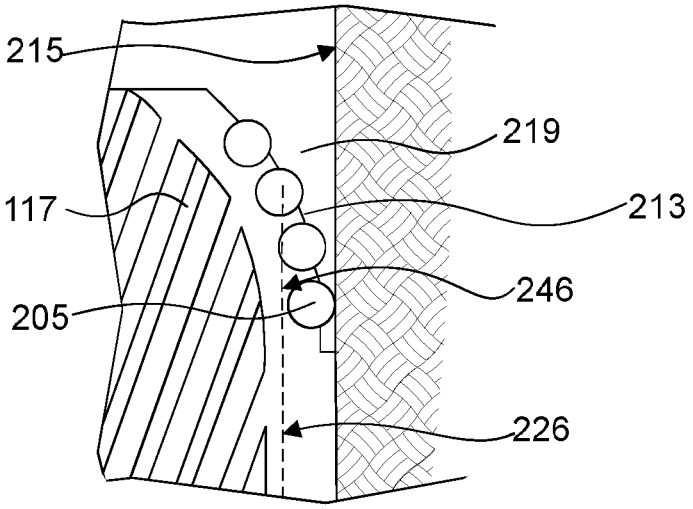
FIG. 11 is a side view onto the upper part of a cutter block, showing another possible modification.
Figure 12:
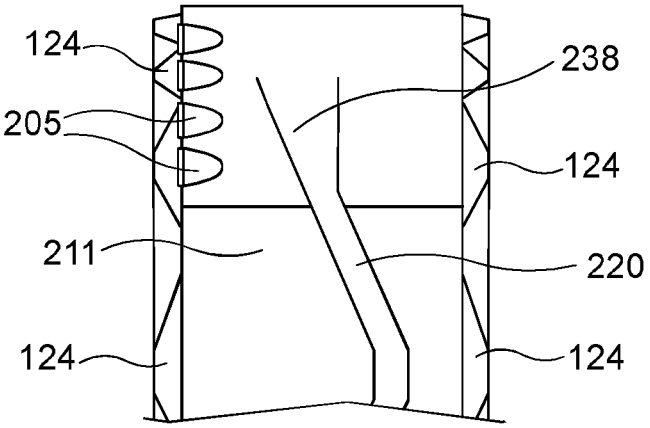
FIG. 12 is a view onto the upper part of the radially outer face of the cutter block of FIG. 11.

FIGS. 11 and 12 show another possible modification to the cutter block of FIGS. 4 to 7. In the lower cutting region 203 the channel is just the same as shown in FIG. 6 with the floor 226 of the channel at approximately constant distance radially inwardly from the outer face of the cutter block as shown by the broken line 226 in FIG. 5. The channel runs through the stabilising pad 211 with the floor 226 of the channel parallel to the surface of the stabilising pad 211 and so also parallel to the tool axis as is the case in the block of FIGS. 4 to 7. However, in the modification shown by FIGS. 11 and 12, the floor 226 (shown as a broken line) of the channel 220 continues parallel to the tool axis in the region above the stabilising pad 211, as indicated at 246, until it intersects the curved surface 213 of the upper cutting region 201. The channel thus finishes before it reaches the upper end of the block 122. Drilling fluid flowing along the channel comes out into the space 219 between the wall 215 of the enlarged borehole and the upper cutting region 201.

An optional further detail shown in FIG. 12 is that in the area 238 where the channel extends into the upper cutting region 201, its side walls are no longer at a constant distance apart but diverge as shown.

Figure 13:
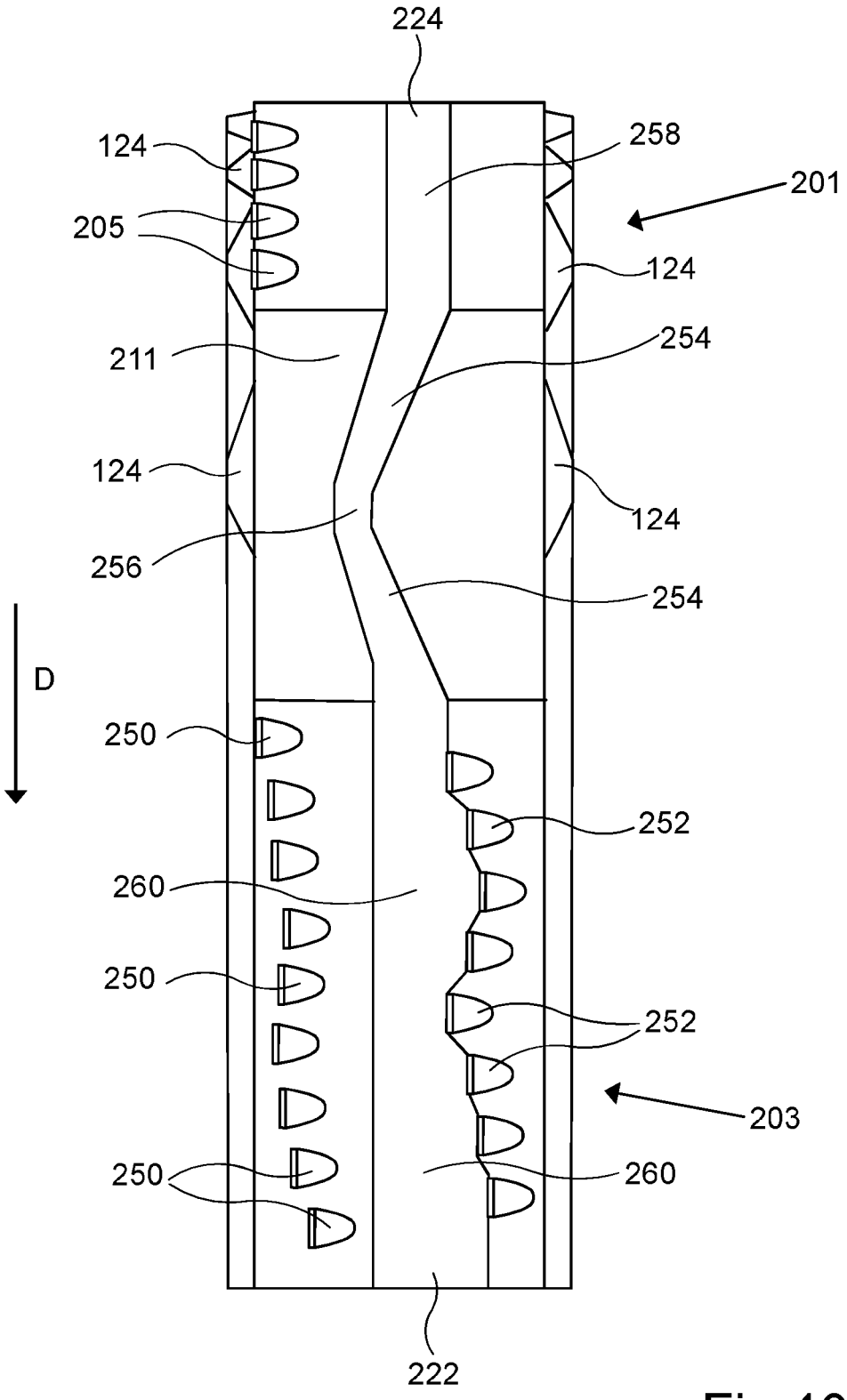
FIG. 13 is a view onto the radially outer face of another embodiment of cutter block.

FIG. 13 shows a further embodiment of cutter block. The upper and lower cutting regions 201 and 203 both have PDC cutters which are partially embedded and project radially outwardly from the block surface. The upper cutting region 201 is largely the same as shown in FIGS. 4 to 6 with four cutters 205. The PDC cutters in the lower cutting region 203 are arranged in a leading row of cutters 250 and a following row of cutters 252. Neither of these rows is precisely aligned, so that, as explained above with reference to FIG. 9, neither of them creates a straight axial line parallel to the tool axis. The cutters 252 are positioned axially so as to face gaps between the cutters 250 in the leading row. In this construction, the extremities of cutters 250 and 252 contact the borehole wall as they cut it, but the only other area which contacts the borehole wall is the stabilising pad 211.

A channel runs along the axial length of the block from an inlet opening 222 at the lower end of the block to an outlet opening 224 at the upper end of the block. Where this channel crosses the stabilising pad 211, it is formed by sections 254 which have trailing edges inclined at approximately 25° angles to the tool axis and leading edges inclined at lesser angles. The two sections 254 are connected by a short section 256 in which the leading and trailing edges are parallel to the tool axis but are shorter than the inclined sections 254. In the lower cutting region 203 there is a section 260 of the channel which runs between the leading row of cutters 250 and the following row of cutters 252. Here, where there is no direct contact between the channel edges and the borehole wall, the leading edge is straight and parallel to the tool axis and the trailing edge is a succession of edges arranged so that the hard faces of the cutters 252 coincide with the trailing edge of the channel. This allows insertion of these cutters 252. In a section 258 of the upper cutting region 201, the channel edges again do not contact the borehole wall and both edges are parallel to the tool axis.

Figure 14:
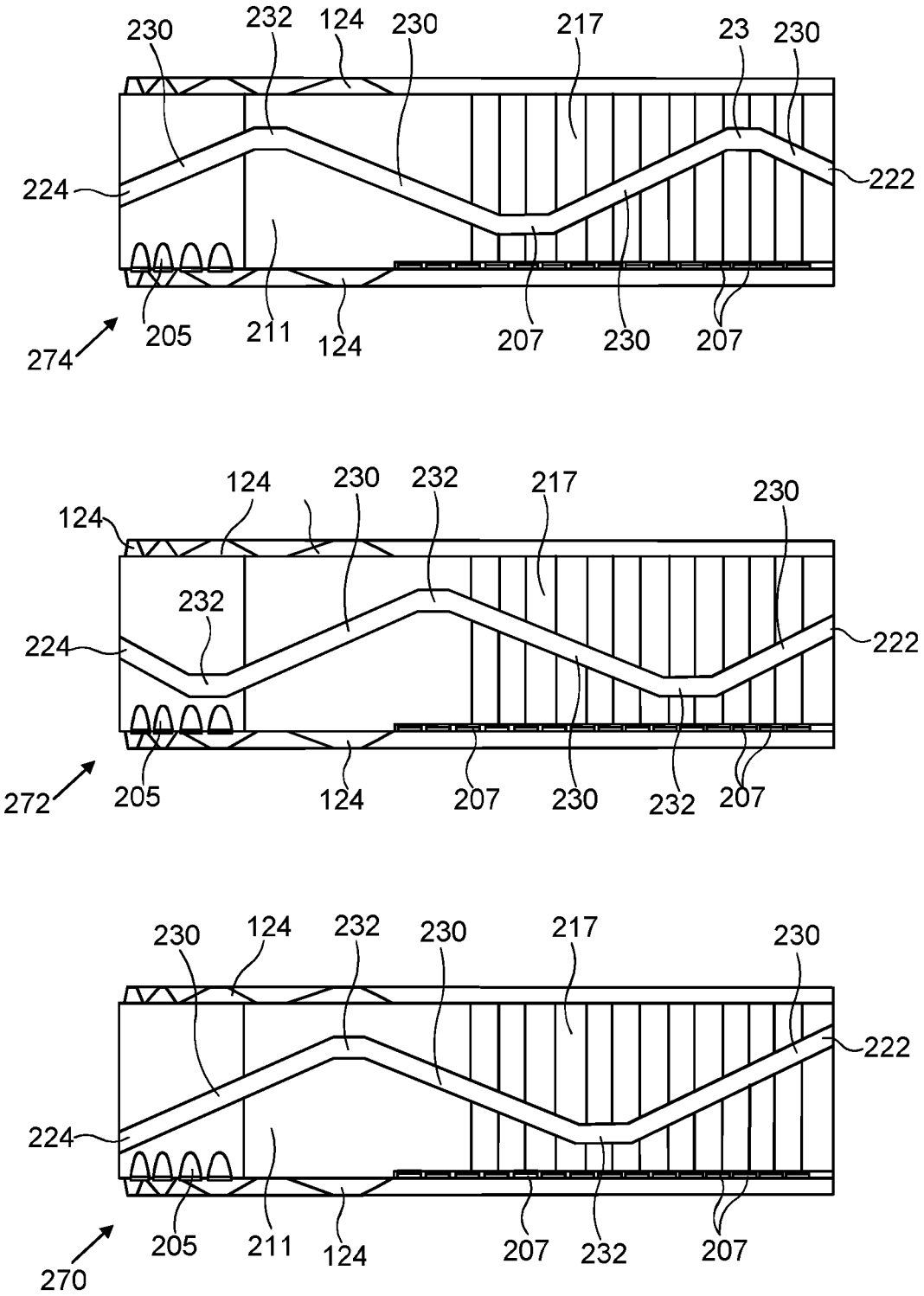
FIG. 14 shows the radially outward faces of three cutter blocks of a reamer, illustrating a further possibility.

FIG. 14 illustrates a further possibility. This drawing shows the radially outward faces of the three cutter blocks which are distributed azimuthally around the body of a reamer and are extendable from the body of the reamer by the mechanism shown in FIGS. 2 and 3.

Each block is similar to the blocks shown by FIGS. 4 to 7. However, in order to further reduce symmetry the three channels 220 are not positioned identically. The channel 220 on block 270 is the same is in FIG. 6. The channels in blocks 272 and 274 are offset in the axial direction of the reamer, with addition of changes of direction at axial portions 232 as required to keep the channels 220 within the width available. In the event that the trailing edge of the channel in one of the axial portions 232 did snag on a feature of the formation as the reamer rotates, the other two blocks are less likely to snag on the same feature because their channels have axial portions 232 at different axial positions.

For the purpose of explanation the three blocks 270, 272, 274 have been shown with cutters 205, 207 and stabilising pads 211 which are identical. However, this need not be the case: these features may also show some variation between the three blocks.

Modifications to the embodiments illustrated and described above are possible, and features shown in the drawings may be used separately or in any combination. The arrangements of stabilising pads and cutters could also be used in a reamer which does not expand and instead has cutter blocks at a fixed distance from the reamer axis. Other mechanisms for expanding a reamer are known and may be used.

The invention claimed is:

1. A downhole cutting tool for enlarging a diameter of a borehole, the tool comprising:

a rotary tool body with at least one support member carrying cutters and extensible from the tool body, the rotary tool body and the at least one support member being rotatable about a tool axis of the rotary tool body, wherein the at least one support member has rotationally leading and trailing side faces and at least one outward facing surface between the side faces, wherein the at least one outward facing surface of the support member defines a channel for fluid flow, the channel having rotationally leading and trailing edges extending axially along the support member between opposing upper and lower axial ends of the support member, and wherein at least the rotationally trailing edge of the channel extends along the support member in one or more directions which are inclined relative to the tool axis and the leading side face, with the channel remaining within a width of the support member along a full length of the channel.

2. The tool according to claim 1 wherein at least 75% of a length of the trailing edge of the channel is inclined at an angle in a range from about 10° to 45° relative to the tool axis.

3. The tool according to claim 1 wherein at least 75% of a length of the trailing edge of the channel is inclined at an angle in a range from about 15° to 45° relative to the tool axis, such that a distance varies between the trailing edge of the channel and a leading edge of the at least one support member, the leading edge of the support member being at an interface between the leading side face and the at least one outward facing surface.

4. The tool according to claim 1 wherein at least 75% of the lengths of the leading and trailing edges of the channel are inclined at an angle in a range from about 15° to 45° relative to the tool axis.

5. The tool according to claim 1 wherein the channel is of approximately constant width along at least 75% of a length of the channel.

6. The tool according to claim 1 wherein the at least one support member is a block to which hard faced cutters are attached.

7. The tool according to claim 1 wherein the at least one support member comprises a cutting region with cutters at progressively increasing radial distance from the tool axis and a stabilising pad positioned to contact the borehole at the diameter to which the cutters enlarge the borehole and wherein the channel extends over the cutting region and the stabilising pad.

8. The tool according to claim 1 wherein the tool comprises at least three support members distributed azimuthally around the tool body, each support member is a block with a plurality of hard faced cutters attached to the block, and a radially outward facing part of each block comprises the channel.

9. The tool according to claim 8 wherein the channels on the support members differ from each other in their shape or in their positions on the support members.

10. The tool according to claim 1 wherein the tool comprises a plurality of support members distributed azimuthally around the tool body and the tool body comprises a mechanism for extending the support members outwardly from the tool body.

11. A method of enlarging a borehole, the method comprising:

inserting a tool in accordance with claim 1 into the borehole, and rotating the tool to enlarge the diameter of the borehole while flowing fluid from at or near a surface of the Earth to the tool and returning fluid from the tool to the surface while at least part of the fluid flow-travels along the channel of the at least one support member.

12. The downhole cutting tool of claim 1, the channel extending a full length of the support member.

13. The downhole cutting tool of claim 1, wherein at least the rotationally trailing edge of the channel extends along the support member in a path that includes portions that are angled at an angle of 15° to 45° relative to the tool axis.

14. The downhole cutting tool of claim 1, the channel having an outlet at each of the opposing axial ends of the support member.

15. The downhole cutting tool of claim 1, the rotationally leading edge of the channel extending along the support member in one or more directions which are inclined relative to the tool axis and the leading and trailing side faces and at a different angle than the at least one rotationally trailing edge.

16. A downhole cutting tool for enlarging a diameter of a borehole, the tool comprising:

a rotary tool body with at least one support member carrying cutters and extensible from the tool body, the rotary tool body and the at least one support member being rotatable about a tool axis of the rotary tool body, wherein the at least one support member has rotationally leading and trailing side faces and at least one outward facing surface between the side faces, wherein the at least one outward facing surface of the support member defines a channel for fluid flow, the channel having rotationally leading and trailing edges extending axially along the support member between opposing upper and lower axial ends of the support member, and wherein at least the rotationally trailing edge of the channel extends along the support member in one or more directions which are inclined relative to the tool axis, with the channel remaining within a width of the support member along a full length of the channel, the rotationally trailing edge of the channel including a first portion extending in a first direction inclined toward the rotationally leading side face and a second portion extending in a second direction inclined toward the rotationally trailing side face.

17. The downhole cutting tool of claim 16, the rotationally trailing edge of the channel including a connecting portion between the first and second portions, where the connecting portion is rotationally offset from the rotationally leading and trailing side faces.

18. The downhole cutting tool of claim 17, the connecting portion extending parallel to the tool axis.

19. The downhole cutting tool of claim 16, the rotationally trailing edge of the channel including a third portion extending in a third direction inclined toward the rotationally leading side face.

20. The downhole cutting tool of claim 19, the rotationally trailing edge of the channel including one or more connecting portions, the one or more connecting portions connecting at least one of the first portion to the second portion or connecting the second portion to the third portion, each of the one or more connecting portions being rotationally offset from the rotationally leading and trailing side faces.

* * * * *